US006076491A

United States Patent [19]

Allen

[11] Patent Number: 6,076,491

[45] **Date of Patent: *Jun. 20, 2000**

[54] VALVE CONTROL MECHANISM

[75] Inventor: Jeffrey Allen, Norfolk, United Kingdom

[73] Assignee: Lotus Cars Limited, Norfolk, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/246,005

[22] Filed: Nov. 6, 1998

Related U.S. Application Data

[63] Continuation of application No. 09/081,329, May 19, 1998, abandoned, which is a continuation of application No. 08/742,928, Nov. 1, 1996, abandoned, which is a continuation of application No. PCT/GB95/01011, May 3, 1995.

[30] Foreign Application Priority Data

May 3, 1994 [GB] United Kingdom ..... 9408715
Jun. 13, 1994 [GB] United Kingdom ..... 9411802

[51] Int. Cl.[7] ..... F01L 13/00

[52] U.S. Cl. ..... 123/90.16; 123/90.55; 123/198 F; 251/77; 251/263; 251/337

[58] Field of Search ..... 123/90.15, 90.16, 123/90.17, 90.48, 90.55, 198 F; 251/251, 263, 337, 77

[56] References Cited

U.S. PATENT DOCUMENTS

| | | | |
|---|---|---|---|
| 4,333,430 | 6/1982 | Rosquist . | |
| 4,336,775 | 6/1982 | Meyer . | |
| 5,090,364 | 2/1992 | McCarroll et al. | 123/90.16 |
| 5,287,830 | 2/1994 | Dopson et al. | 123/90.16 |
| 5,343,833 | 9/1994 | Shirai . | |
| 5,361,734 | 11/1994 | Shirai . | |
| 5,555,861 | 9/1996 | Mayr et al. . | |
| 5,694,894 | 12/1997 | Allen . | |

FOREIGN PATENT DOCUMENTS

| | | |
|---|---|---|
| 9411680 | 10/1994 | Germany . |
| 61-118514 | 6/1986 | Japan . |
| 61-118515 | 6/1986 | Japan . |
| WO 93/18284 | 9/1993 | WIPO . |
| WO 94/21899 | 9/1994 | WIPO . |

*Primary Examiner*—Weilun Lo
*Attorney, Agent, or Firm*—Fulwider Patton Lee & Utecht, LLP

[57] ABSTRACT

The valve control mechanism is suitable for use in a valve train which transmits lifts from a cam (11) located on a camshaft (10) of an internal combustion engine to a cylinder head valve (217) of the internal combustion engine and which has a first abutment member (212) in abutment with the cam (11) and a second abutment member (215) in abutment with the top of the stem of the cylinder head valve (217). The valve control mechanism comprises a first tappet member (212) slidable in a bore in the engine, a second tappet member (213) moveable relative to the first tappet member (212) and locking means (220, 221, 222, 223) capable of locking the first (212) and the second (213) tappet members to move together. When the locking means (220, 221, 222, 223) locks the first (212) and second (213) tappet members to move together, the valve control mechanism transmits all of the lift of the cam (11) to the cylinder head valve (217). When the locking means (220, 221, 222, 223) allows the first (212) and second (213) tappet members to move relative to each other at least a part of the lift of the cam (11) causes relative motion between the first (212) and second (213) tappet members rather than lift of the cylinder valve (217), whereby the valve control mechanism reduces the amount of lift that is transmitted from the cam (11) to the cylinder head valve (217). In the first aspect of the invention the valve control mechanism is characterised in that one of the tappet members (212, 213) is connectable with the camshaft only via the other tappet member (212, 213). In a second aspect, the invention is characterised in that the locking means (220, 221, 222 and 223) comprises biasing means (222, 223) which apply a permanent bias on the locking means (220, 221, 222, 223) acting to bias the locking means (220, 221, 222, 223) into a first operating condition in which the locking means (220, 221, 222, 223) lock the first (212) and the second (213) tappet members to move together.

13 Claims, 3 Drawing Sheets

VALVE CONTROL MECHANISM

RELATED APPLICATIONS

This is a continuation of Ser. No. 09/081,329 filed May 19, 1998, now abandoned, and which is a continuation of Ser. No. 08/742,928 filed Nov. 1, 1996, now abandoned, which was a continuation of PCT/GB95/01011 filed May 3, 1995.

The present invention relates to a valve mechanism for controlling a cylinder head valve of an internal combustion engine.

It is common practice in internal combustion engines to have poppet valves which open and close inlet and exhaust ports in the cylinder head. It is also common practice to control the motion of the poppet valves by the use of a cam shaft. The cam shaft rotates in time with the rotation of the engine and has a plurality of cams. A tappet assembly is provided for each poppet valve, each tappet assembly engaging one cam of the cam shaft. The tappet assemblies relay motion from the cams of the cam shaft to the poppet valves.

In conventional engines the lift of a particular cam is always transmitted to the controlled poppet valve, in all engine conditions. However, this is not always desirable. There are many engines today which have four or more poppet valves for each cylinder head. This improves performance of the engine at high engine speeds and loads. However, at low engine speeds or loads use of all four valves is not necessary and indeed can be detrimental to engine emissions and fuel economy. Therefore, there have been proposed in the past various cam mechanisms which can de-activate a poppet valve in certain engine operating conditions.

In DE-2952037 there is shown a valve control mechanism which allows de-activation of a poppet valve. The valve control mechanism comprises a cylindrical member which has a bore axially therethrough, the bore being closed at one end. The stem of the controlled poppet valve is slidable in the bore in the cylindrical member. A locking member is provided in the cylindrical member which is movable radially of the cylindrical member. The locking member is movable between a first position in which the poppet valve and the cylindrical member are free to slide relative to one another and a second position in which the locking member engages the top of the stem of the poppet valve so that the poppet valve and the cylindrical member move together. The cylindrical member of the tappet assembly engages a cam of a cam shaft to the engine. Thus, when the locking member is in its second position, the lift of the cam engaged by the cylindrical member is transmitted by the cylindrical member to the poppet valve and poppet valve is activated. However, when the locking member of the tappet assembly is in its first position, the cylindrical member can slide relative to the poppet valve and the lift of the cam therefore causes only relative motion between the cylindrical member and the poppet valve and no lift is relayed to the poppet valve; in other words the poppet valve is de-activated.

The system of DE-2952037 requires that the valve stem of the poppet valve is itself movable within the cylindrical member of the tappet assembly. This has certain disadvantages. First of all, the arrangement requires modification of existing components, such as the valve stem of the poppet valve and the cylinder head construction. Secondly, there is a problem faced if the valve when de-activated remains fully closed at all times. Generally speaking, in fuel injection engines fuel is injected onto the back of the poppet valves, for release into the cylinder as air passes the poppet valves.

If a poppet valve remains fully closed for a period of time, then a puddle of fuel builds up behind the poppet valve, leading to undesirable effects when the poppet valve is subsequently opened.

To enable use of the system of DE-2952037 it is necessary to employ precise machining techniques in manufacturing of an engine cylinder head. The system of DE-2952037 requires the stem of a poppet valve to move within a bore of a cylindrical member. The poppet valve will be located in use in a first bore in the cylinder head and the cylindrical member will be located in a second bore in the cylinder head. In practice, both bores would be machined separately. To use the system of DE-2952037 careful machining of the two bores would be necessary to ensure axial alignment.

In WO 91/12413 there is illustrated a valve control mechanism which has first and second tappet members mounted co-axially in a bore in an engine, the outer tappet member engaging a first cam mounted in a camshaft of the engine and the inner tappet member engaging a second cam on the camshaft of lower lift than the first cam. The inner tappet is slidable in a bore which extends axially along the whole length of the outer tappet. The inner tappet abuts the top of a stem of a cylinder head valve of the engine. Locking means are provided to lock the inner and outer tappets to move together. When the tappets are unlocked then the valve is controlled by the inner tappet which follows the profile of the lower lift cam. When the tappets are locked then the valve is controlled by the lift of the higher lift cam.

The present invention provides a valve control mechanism suitable for use in a valve train which transmits lift from a cam located on a camshaft of an internal combustion engine to a cylinder head valve of the internal combustion engine and which has a first abutment member in abutment with the cam and a second abutment member in abutment with the top of the stem of the cylinder head valve, the valve control mechanism comprising:

- a first tappet member slidable in a bore in the engine,
- a second tappet member slidable relative to the first tappet member, and
- locking means capable of locking the first and second tappet members to move together, wherein
- when the locking means locks the first and second tappet members to move together the valve control mechanism transmits all of the lift of the cam to the cylinder head valve, and
- when the locking means allows the first and second tappet members to move relative to each other at least a part of the lift of the cam causes relative motion between the inner and outer tappet members rather than lift of the cylinder head valve, whereby the valve control mechanism reduces the amount of lift of the cam that is transmitted to the cylinder head valve,
- characterised in that one of the tappet members is connectable with the camshaft only via the other tappet member.

The invention provides a valve control mechanism which can be used in an engine without extensive modification of existing components. The mechanism can be easily converted to allow small valve lift rather than total deactivation. The mechanism removes the need for close alignment of two different bores in the engine cylinder head. The mechanism is equally applicable in overhead camshaft and push rod engines.

The tappet member which is connectable with the cam could be in direct engagement with the cam or indirect engagement with the cam (e.g. through a rockable cam follower member). The other tappet member would normally abut the stem of a cylinder head valve in an overhead camshaft engine or a push-rod in a push-rod engine.

The first tappet member is preferably an outer tappet member which has a bore therein and the second tappet member is preferably an inner tappet member slidable in the bore of the outer tappet member.

The valve control mechanism can be configured to transmit none of the lift of the cam to the cylinder head valve when the locking means allows the inner and outer tappet members to move relative to each other.

Alternatively the valve control mechanism can be configured to transmit a part of the lift of the cam to the cylinder head valve when the locking means allows the inner and outer tappet members to move relative to each other. This can be done by providing the bore in the outer tappet member with a closed end so that in each rotation of the cam, as the lift of the cam initially increases the inner tappet member slides along the closed bore of the outer tappet member until the inner tappet member abuts the closed end of the bore, whereafter further increasing lift of the cam causes lift of the cylinder head valve.

Preferably the inner tappet member has a surface which in use faces the closed end of the bore and has oil retaining means provided on the surface, the oil retaining means in use retaining a film of oil on the surface which acts to damp relative motion between the inner and outer tappet member as the surface nears abutment with the closed end of the bore.

In a first preferred embodiment of the invention the locking means comprises

- a locking pin slidable in a bore provided in the inner tappet member and
- a slot provided in the outer tappet member, wherein
- the locking pin is slidable between a first position in which the locking pin extends outwardly from the inner tappet member to engage the slot in the outer tappet member and a second position in which the locking pin is out of engagement with the slot in the outer tappet member.

Preferably in the first preferred embodiment the locking means comprises spring means for biasing the locking pin into the second position, and hydraulic fluid supply means operable to supply hydraulic fluid to the valve control mechanism to apply pressure on the locking pin to slide the locking pin from the second position to the first position against the biasing force of the spring means.

In a second preferred embodiment of the invention the locking means comprises

- a locking pin slidable in a bore provided in the outer tappet member and
- a slot provided in the inner tappet member, wherein
- the locking pin is slidable between a first position in which the locking pin extends inwardly from the outer tappet member to engage the slot in the inner tappet member and a second position in which the locking pin is out of engagement with the slot in the inner tappet member.

In the second preferred embodiment the locking means preferably comprises spring means for biasing the locking pin into the first position and hydraulic fluid supply means operable to supply hydraulic fluid to apply pressure on the locking pin to slide the locking pin from the first position to the second position against the biasing force of the spring means.

Preferably biasing means is provided to act between the inner and outer tappets to bias the inner and outer tappets into a position relative to each other in which the locking pin aligns with the slots in the outer tappet member. Preferably the biasing means comprises a tapered spring which can be compressed to a substantially flat state and which is located in the closed bore in the outer tappet member.

Preferably a hydraulic lash adjuster is provided in a closed bore in the inner tappet member, the hydraulic lash adjuster in use extending to compensate for wear of components of the engine.

In WO 91/12413 the valve control mechanism has locking means comprising a locking pin which is slidable in a transverse bore in the outer tappet member between a position in which it engages the inner tappet member to lock the tappet members to move together and a position in which the locking pin is positioned wholly within the outer tappet member and the inner and outer tappet members are free to move relative to one another. A spring is provided to apply a permanent bias on the locking pin which acts to bring the locking pin into the position in which the inner and outer tappet members are free to move relative to one another. Hydraulic pressure is used to act against the spring to move the locking pin to a position in which it interengages the two tappets.

The present invention provides in a second aspect a valve control mechanism suitable for use in a valve train which transmits lift from a cam located on a camshaft of an internal combustion engine to a cylinder head valve of the internal combustion engine and which has a first abutment member in abutment with the cam and a second abutment member in abutment with the top of the stem of the cylinder head valve, the valve control mechanism comprising:

- a first tappet member which in use of the valve control mechanism is in engagement with the cam,
- a second tappet member movable relative to the first tappet member which in use of the valve control mechanism is in engagement with the cylinder head valve, and
- locking means capable of locking the first and second tappet members to move together, wherein
- the locking means has a first operating condition in which the locking means locks the first and second tappet members to move together and the valve control mechanism transmits lift from the cam engaged by the first tappet member via the locking means from the first tappet member to the second tappet member and thence to the cylinder head valve, and
- the locking means has a second operating condition in which the locking means allows the first and second tappet members to move relative to each other and in which no lift is transmitted via the locking means from the first tappet member to the second tappet member,
- characterised in that the locking means comprises biasing means which applies a permanent bias on the locking means acting to bias the locking means into the first operating condition.

It should be appreciated that the first tappet member could either directly engage a cam or indirectly engage a cam via other valve train elements (e.g. a cam follower member interposed between the cam and the first tappet member). Also it should be appreciated that the second tappet member could either directly engage a valve or indirectly engage a valve (e.g. via a push-rod and rocker arm).

It has been appreciated by the applicant that the valve deactivation and cam profile switching systems of the prior art (e.g. WO 91/12413) in which two tappet members are locked and unlocked by locking means are configured so that hydraulic pressure is needed to lock the tappet members together. However, when an engine is first started no hydraulic pressure will be available and the tappet member will be unlocked. This can be disadvantageous of, for instance, a particular valve is deactivated when the tappet members associated therewith are unlocked, since at start up it is beneficial to have all valves working. The invention in its second aspect solves this problem by biasing the locking means into a condition in which the two tappet members are locked to move together. This aspect of the invention is applicable to any system in which two tappet members (e.g. reciprocating cylindrical tappet members, rocker followers, finger followers) are locked together to achieve switching between two different valve operating conditions.

Preferably the valve control mechanism comprises hydraulic control means for controlling the locking means, the hydraulic control means switching the locking means between the first and second operating conditions by controlling the pressure of hydraulic fluid supplied to the locking means, the hydraulic control means supplying a first hydraulic pressure insufficient to overcome the biasing means when controlling the locking means to operate in the first operating condition and a second higher hydraulic pressure sufficient to overcome the biasing means when controlling the locking means to operate in the second operating condition.

Preferably the locking means comprises a locking pin movable in a bore in the first or second tappet member between a first position in which the locking pin interengages the tappet members to link the tappet members to move together and a second position in which the locking pin does not interengage the tappet members and the tappet members are free to move relative to each other.

Preferably the biasing means comprises spring means for biasing the locking pin into the second position thereof.

Preferably the first tappet member is an outer tappet member and the second tappet member is an inner tappet member slidable along the axis of a bore in the outer tappet member, the locking pin being slidable in a bore in the outer tappet member and the biasing means comprising a spring acting to bias the locking pin inwardly.

Preferably hydraulic control means is provided which supplies hydraulic fluid via a passage in the inner tappet member to act on the innermost surface of the locking pin.

Preferred embodiments of the present invention will now be described with reference to the accompanying drawings in which.

Figure 1:
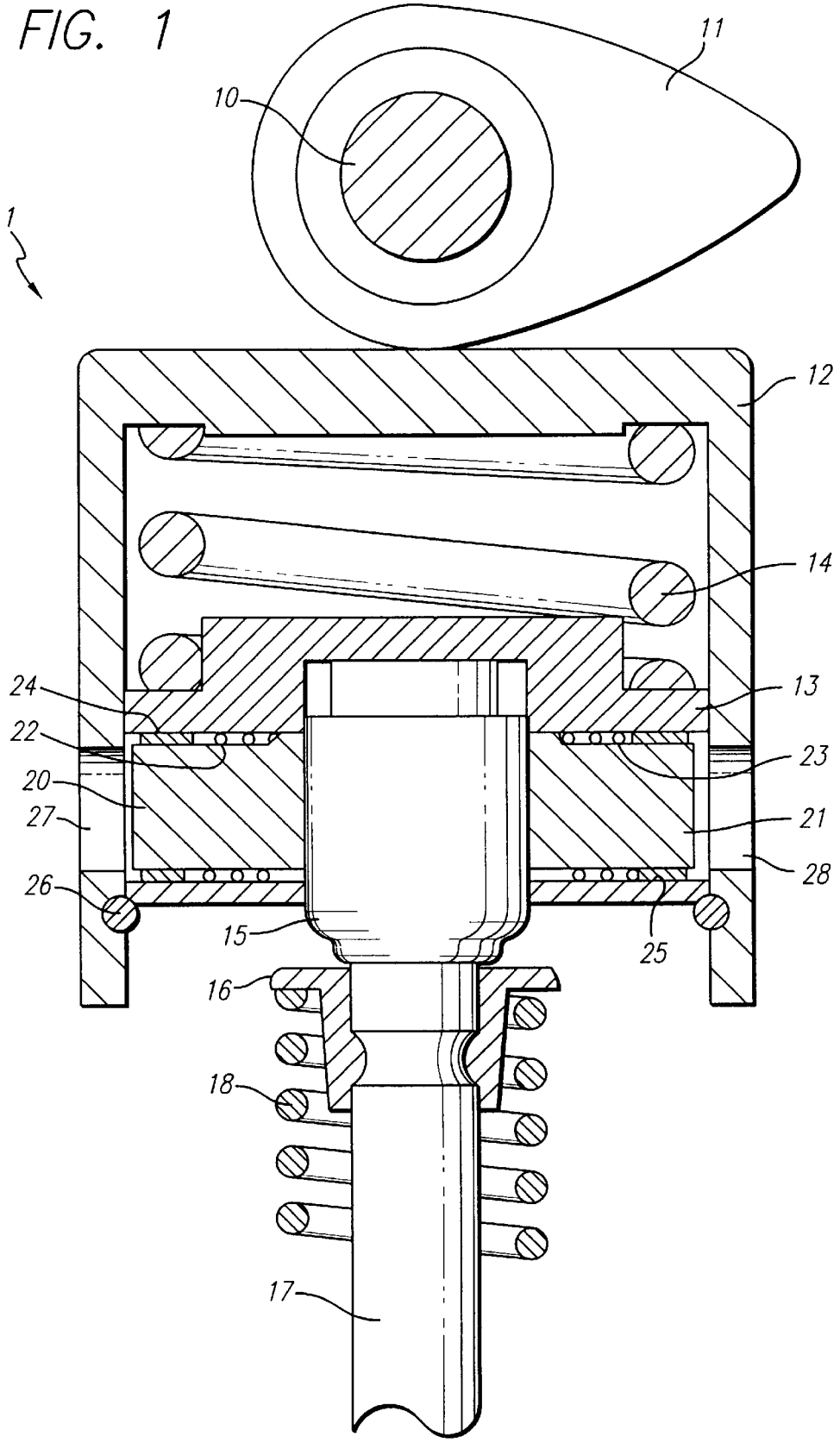
FIG. 1 is a schematic cross-sectional view through a part of the cylinder head of an engine, showing in cross-section a first embodiment of valve control mechanism according to the invention.

In FIG. 1 there can be seen a cam shaft 10 on which there is provided a cam 11. The cam shaft 10 will be rotated by a drive system (eg. a cam belt, chain or gear train) at a speed related to the speed of rotation of the crank shaft of the engine in which the cam shaft is present.

The lift of the cam 11 is relayed to a controlled poppet valve via a valve control mechanism 1.

The cam 11 engages a top surface of a cylindrical outer tappet member 12 of the valve control mechanism 1. The outer tappet member 12 is slidable in a bore provided in the cylinder head of an engine. The cylindrical tappet member 12 contains therein an inner tappet member 13 which is slidable relative to the outer tappet member 12 in a closed bore provided in the outer tappet member 12. The inner tappet member 13 is cylindrical in nature and has an outer diameter which corresponds to the diameter of the bore in the outer tappet member 12.

Acting between the outer tappet member 12 and the inner tappet member 13 is a spring 14.

A cylindrical bore is provided in the centre of the cylindrical inner tappet 13. In the cylindrical bore there is provided a hydraulic lash adjuster 15, of conventional construction. The hydraulic lash adjuster 15 acts between the inner tappet member 13 and the top of the valve 17 which is a poppet valve of an internal combustion engine. The poppet valve 17 would typically be an inlet valve, but could also be an exhaust valve.

Attached to the valve 17 is a spring retainer 16. Acting on the spring retainer 16 is a valve spring 18 which biases the valve 17 into abutment with its valve seat (not shown).

A bore is provided diametrically across the inner tappet member 13. In the bore there are located two locking pins 20 and 21. The locking pins 20 and 21 are respectively inwardly biased by springs 22 and 23. The spring 22 acts between the locking pin 20 and a shoulder 24 provided in the diametrically extending bore. The spring 23 acts between the locking pin 21 and a shoulder 25 provided in the diametrically extending bore.

A snap-ring 26 is provided extending round the interior surface of the outer tappet 12, the snap-ring 26 limiting the downward motion of the inner tappet member 13 relative to the outer tappet member 12. The spring 14 biases the inner tappet member 13 into engagement with the snap-ring 26.

In use, the valve control mechanism 1 has two operating conditions. In the first operating condition, which is shown in FIG. 1, the locking pins 20 and 21 are held inward by the biasing springs 23 and 22. Thus, the locking pins 20 and 21 are held out of engagement with the outer cylindrical member 12 and the outer tappet member 12 can move relative to the inner tappet member 13. Hence, the lift of the cam 11 in the first operating condition is not transmitted to the valve 17, because the lift of the cam 11 is taken up by relative motion between the outer tappet member and the inner tappet member 13. It should be appreciated that the valve spring 18 is stiffer than the spring 14 and therefore the spring 14 compresses to allow relative motion between tappet members 12 and 13, before the valve spring 18 allows any movement of the valve 17.

In the second operating condition of the tappet assembly 1 the locking pins 20 and 21 are pushed radially outwardly from the inner tappet member 13 to engage slots 27 and 28 provided in the outer tappet member 12. The locking pins 20 and 21 are pushed radially outwardly by hydraulic pressure acting on their radially innermost surfaces. The hydraulic lash adjuster 15 and the radially innermost surfaces of the locking pins 20 and 21 are both connected to a supply of hydraulic fluid through a passage in the inner member 13 which is not shown. The passage in the inner member 13 will extend out from the plane of the cross-section to an aperture in the exterior surface of the inner tappet member 13. The aperture in the exterior surface of the inner tappet member will align with a slot provided in the outer tappet member 12, which will in turn align with a passage for hydraulic fluid provided in the cylinder head of the engine.

Once the locking pins 20 and 21 have been extended under the influence of hydraulic pressure, they will engage the slots 27 and 28 in the outer tappet member 12. Thus, the outer tappet member 12 is locked to the inner tappet member 13 and both move together. Consequently, the lift of the cam 11 is transmitted through the outer tappet member 12 and the two locking pins 20 and 21 to the inner tappet member 13 and thence to the valve 17, so that the valve is given the full lift of the cam 11 and is activated.

The supply of hydraulic fluid to the innermost surfaces of the locking pins 20 and 21 will be controlled by a control system which is not shown in the drawings. The control system will be able to switch the hydraulic pressure from low pressure, which is sufficient only to supply fluid to the hydraulic lash adjuster 15, to a high pressure which is sufficient to overcome the biasing force of the springs 22 and 23, in order that the locking pins 20 and 21 can be extended radially outwardly. When the hydraulic pressure is switched back from high pressure to low pressure, the biasing springs 22 and 23 will return the locking pins 20 and 21 to a retracted position, so that the outer tappet member 12 can move relative to the inner tappet member 13 (the valve thus being de-activated).

The snap-ring 26 limits the downward motion of the inner tappet member 13 relative to the outer tapper member 12. This then gives the hydraulic lash adjuster 15 a fixed reference to work from. Hydraulic lash adjusters such as the adjuster 15 are well known in the prior art and therefore the hydraulic lash adjuster 15 will not be described in detail in the specification. It is suffice to say that the hydraulic lash adjuster 15 will extend to take up any wear that arises through use.

As shown, the cam mechanism is operable either to fully activate or fully de-activate the valve 17. This arises because the lift of the cam 11 is less than the relative motion that is allowed between the outer tappet 12 and the inner tappet 13 before the top surface of the inner tappet 13 engages the underside of the topmost surface of the outer tappet member 12. However, the valve control mechanism can be modified so that the lift of the cam 11 is greater than the greatest permissible relative motion between the tappet members 12 and 13. In such a case, the valve will never be completely de-activated. Instead, when the locking pins 20 and 21 are retracted and tappet members 12 and 13 can move freely relative to each other, the cam 11 will cause motion of the tappet members relative to each other until a point when the top surface of the inner member 13 contacts the underside of the top surface of the tappet member 12. Thereafter lift is transmitted from the cam to the valve 17. Therefore, in the first operating condition of the valve control mechanism the valve 17 receives a small amount of lift of short duration and is not completely de-activated.

Providing a small lift rather than full de-activation can in fact be preferable in a fuel injected engine. In a fuel injected engine, fuel is generally sprayed onto the rear surfaces of the inlet valves. If an inlet valve is fully de-activated then a puddle of fuel can develop whilst the valve is de-activated, leading to undesirable effects when the valve is next opened. With a minimal amount and duration of lift, the build-up of fuel behind a de-activated inlet valve can be eliminated, whilst the advantages of de-activation the valve are maintained.

The valve control mechanism 1 will operate in its first operating condition (with the valve de-activated or with minimal lift) for low speed and low load operation of the engine. The tappet assembly will operate in a second operating condition (with the controlled valve receiving full lift) at high engine speeds and loads. This is achieved by providing a control system (not shown) which switches the pressure of the hydraulic fluid supplied to the locking pins 20 and 21 from a low to a high pressure (and vice-versa) at certain sensed engine speeds and loads.

The locking pins 20 and 21 are arranged to extend outwardly from the inner member 13 to engage the outer tappet member 12 so as to minimise the reciprocating mass of the valve control mechanism 1 in the first operating condition. This decreases engine losses when the valve control mechanism 1 is in its first operating condition.

Figure 2:
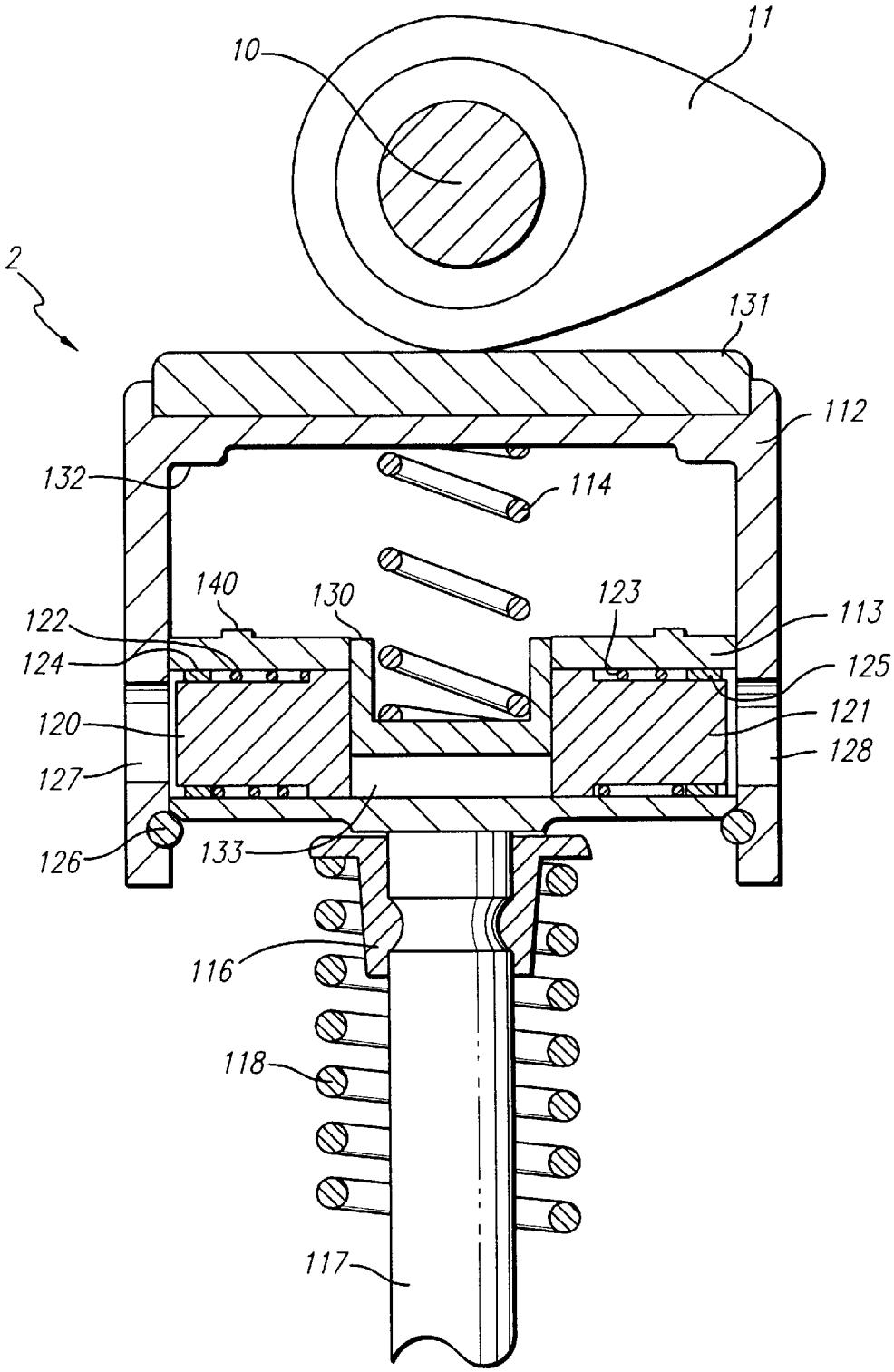
FIG. 2 is a cross-sectional view of a part of a cylinder head of an engine, showing in cross-section a valve control mechanism according to a second embodiment of the invention.

A second embodiment of valve control mechanism according to the invention is shown in FIG. 2. In FIG. 2, there can still be seen a cam shaft 10 with a cam 11 arranged thereon for rotation therewith. The second embodiment of valve control mechanism is denoted by the reference numeral 2 and is in many respects similar to the valve control mechanism 1 already described. The valve control mechanism 2 comprises an outer tappet member 112 which has therein an inner tappet member 113 which is slidable in a closed bore in the outer tappet member 112 relative to the outer tappet member 112. A spring 114 acts between the inner tappet member 113 and the outer tappet member 112 and biases the inner tappet member 113 into engagement with a snap ring 126 provided on the interior of the outer tappet member 112.

The second valve control mechanism 2 does not have a hydraulic lash adjuster and the inner tappet member 113 directly abuts a poppet valve 117 controlled by the tappet assembly. The valve 117 is biased into engagement with its valve seat by the valve spring 118 which acts on a spring retainer 116 attached to the valve 117.

Two locking pins 120 and 121 are provided in a diametrically extending bore in the inner tappet member 113. The locking pins 120 and 121 are respectively biassed by springs 122 and 123 into abutment with a spring seat 130 provided at the centre of the inner tappet member 113 for retaining the spring 114. The spring 124 acts between the locking pin 120 and a shoulder 124 provided in the diametrically extending bore. Similarly, the spring 123 acts between the locking pin 121 and the shoulder 125 provided in the diametrically extending bore.

Instead of having a hydraulic lash adjuster, the tappet assembly 2 makes use of a mechanical shim 131 interposed between the outer tappet member 112 and the cam 11. The shim 131 can be replaced by shims of different thicknesses, in order to achieve the correct working clearance and to compensate for wear of components in the engine (e.g. wear of the cams).

The top surface of the inner tappet member 113 is provided with an oil retainer 140 which takes the form of a ridge on the top surface of the inner tappet member 113. The oil retainer 140 retains in use a film of oil on the top of the inner tappet member 113. This is useful when valve control mechanism 2 is configured such that the lift of the cam 11 exceeds the maximum relative motion permitted between the inner tappet member 113 and the outer tappet member 112. As explained previously, when this occurs, the controlled valve 117 is provided with a small amount of lift which is transmitted from the cam 11 to the poppet valve 117 once the upper surface of the inner tappet 113 abuts the underside of the top surface of the outer tappet 112. By providing a film of oil the impact between the upper surface of the inner tappet 113 and the underside of the top surface of tappet 112 is dampened, avoiding excessive noise and wear. Thus it can be seen in FIG. 2 that the underside of the outer tappet member 112 is in fact provided with a ridge 132 which runs around the perimeter of the underside surface. As the top surface inner tappet member 113 approaches the underside of the outer tappet member 112, the ridge 132 and the oil retainer ridge 140 cooperate to define an ever-reducing annular gap through which oil is forced. This is very effective in damping the final motion of the inner tappet member 123 into abutment with the outer tappet member 112.

Whilst the second embodiment shown in FIG. 2 is configured such that the valve control mechanism in its first operating condition still imparts to the controlled valve 117 a small lift, the tappet assembly could equally well be configured to provide full valve de-activation if desired.

As with the first embodiment, the embodiment shown in FIG. 2 has locking pins which extend radially outwardly of the inner tappet so as to reduce the reciprocating mass of the tappet assembly in the valve de-activated condition.

As with the first embodiment, the second embodiment will have oil passages which enable supply of hydraulic pressure to the radially innermost surfaces of the locking pins 120, 121, so that the locking pins 120 and 121 can be extended under the application of hydraulic pressure. In fact, in the embodiment shown the chamber 133 located below the spring seat 130 will be connected to an oil passage which extends through the inner tappet 113 to open onto the exterior surface of the inner tappet 113 at an aperture which will align with a longitudinally extending slot provided in the outer tappet 112. The slot in the outer tappet 112 will in turn align with an opening of an oil passage provided in the cylinder head. A control mechanism, not shown in the drawings, will be provided for switching the hydraulic pressure supplied between a low pressure at low engine speeds and loads and the high pressure at high engine speeds and loads.

When the hydraulic pressure is switched from low to high, the pins 120, 121 are forced radially outwardly to engage slots 127 and 128 provided in the outer tappet 112 so that both the inner tappet 113 and the outer tappet 112 move together and the lift of cam 11 is transmitted to the valve 117. When the oil pressure is switched back from high to low, the springs 122 and 123 return the locking pins 120 and 121 to a retracted position in which the outer tappet 112 is free to move relative to the inner tappet 113 and the valve 117 is de-activated (or subject only to a small lift).

In the embodiments of FIGS. 1 and 2 the inner tappets 13 and 113 remain disconnected from the outer tappets 12 and 112 when oil pressure is low, due to the biasing force of springs 22, 24 and 122, 124. It is envisaged that there can be situations in which this method of operation will lead to certain difficulties. In cold start situations the oil pressure in an engine will be low and insufficient to cause the locking pins to connect the inner and outer tappets. However, in cold start conditions it is advantageous that all valves are activated in order to allow good starting of the engine. Therefore, in certain circumstances there can be a requirement for the inner and outer tappets to be connected at low engine oil pressures. The embodiment of the invention shown in FIG. 3 achieves this.

Figure 3:
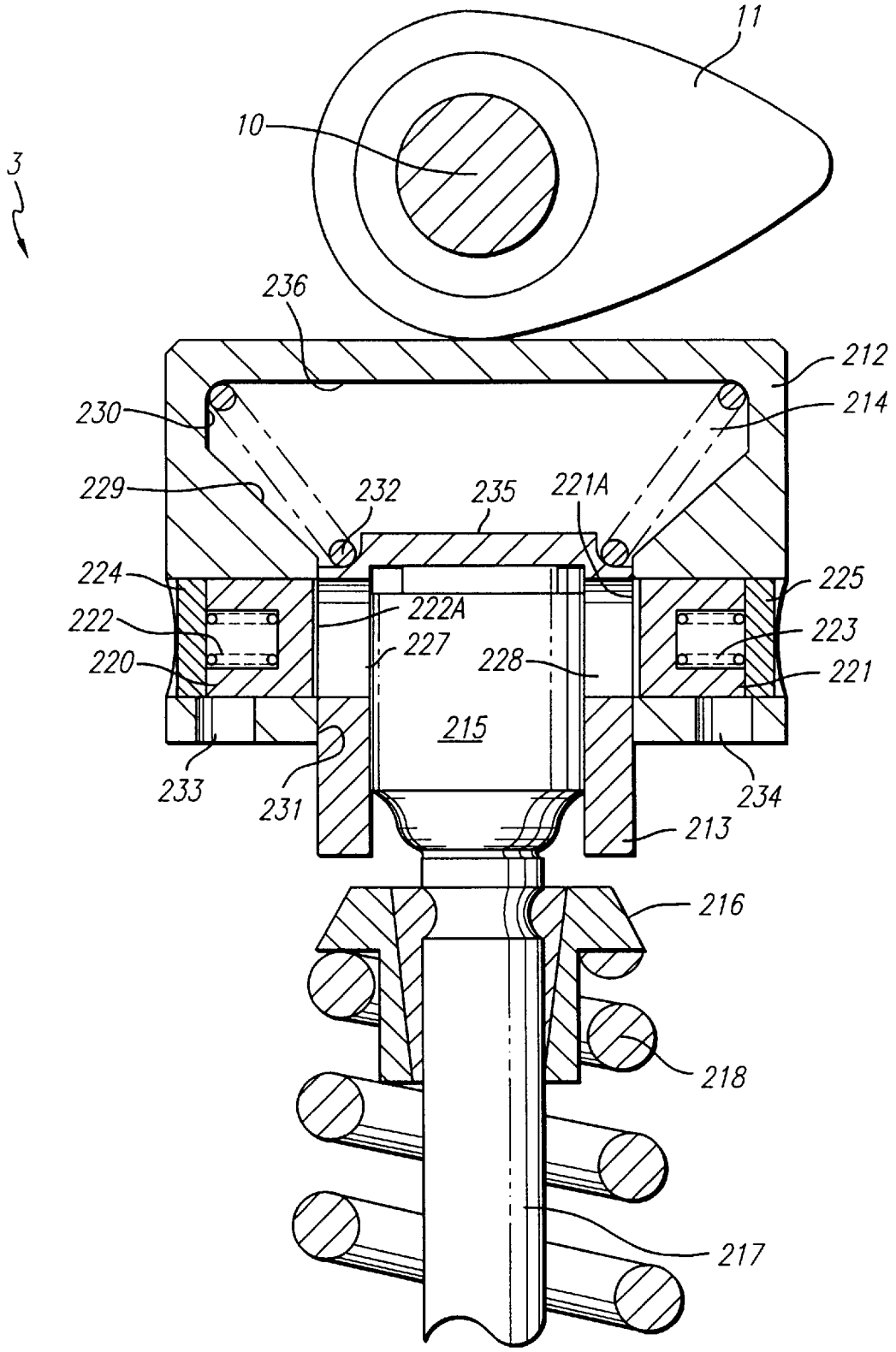
FIG. 3 is a cross-sectional view of a part of a cylinder head of an engine, showing in cross-section a valve control mechanism according to a third embodiment of the invention.

In FIG. 3 there can be seen valve control mechanism 3 which controls the transmission of lift from a cam 11 to a controlled valve 217. The cam 11 is mounted on a camshaft 10 which is rotated by a drive system at a speed related to the speed of rotation of the crankshaft of the engine in which the camshaft 10 is present.

The cam 11 engages a top surface of a cylindrical outer tappet member 212 of the valve control mechanism 3. The outer tappet member 212 is slideable in a bore provided in the cylinder head of an engine. The outer tappet member 212 contains therein an inner tappet member 213 which is slideable relative to the outer tappet member 212 in a closed bore provided in the outer tappet member 212. The inner tappet member 213 is cylindrical in nature and has an outer diameter which corresponds to the interior diameter of the innermost cylindrical surface of the bore in the outer tappet member 212.

Acting between the outer tappet member 212 and the inner tappet member 213 is a spring 214. It can be seen that the spring 214 tapers inwardly as it extends from the top of the closed bore in the outer tappet member 212. The closed bore in the outer tappet member 212 has a correspondingly tapered portion 229 which extends from the upper portion of the bore 230, which is generally cylindrical in nature, to the lowermost portion of the bore 231, again generally cylindrical in nature. The cylindrical uppermost portion 230 of the bore is the largest diameter portion of the bore. The cylindrical lowermost portion 231 of the bore is the smallest diameter portion of the bore, with an internal diameter which matches the external diameter of the inner tappet member 213.

A spring seat 232 is provided on the periphery of the uppermost portion of the inner tappet member 213. The spring seat 232 serves to locate the spring 214 securely within the bore in the outer tappet member 212. The spring 214 is tapered so that it can be compressed to a generally flat condition in which the total height of the spring 24 corresponds to the diameter of the metal strand forming the spring 214. By using such a spring the maximum possible relative motion between the inner 213 and outer 212 tappets is not unduly limited by the height of the spring acting between them when the spring is in its fully compressed state.

A closed cylindrical bore is provided in the centre of the inner tappet member 213. In the cylindrical bore in the inner tappet member 213 there is provided a hydraulic lash adjuster 215. The hydraulic lash adjuster 215 acts between the inner tappet member 213 and the top of the valve 217 controlled by the valve control mechanism 3. The valve 217 will typically be a poppet valve in an internal combustion engine, usually an inlet valve, but also possibly an exhaust valve.

Attached to the valve 217 is a spring retainer 216. Acting on the spring retainer 216 is a valve spring 218 which tapers outwardly from the top of the valve stem of the valve 217 towards the bottom of the valve stem of the valve 217 (assuming that the end of the valve stem nearest the head of the valve is the bottom of the valve stem). The valve spring 218 biases the valve 217 into abutment with its valve seat (not shown).

A bore is provided diametrically across the outer tappet member 212. In the bore there are located two locking pins 220 and 221. The locking pins 220 and 221 are respectively inwardly biased by springs 222 and 223. The spring 222 acts between the locking pin 220 and an abutment member 224 provided in the diametrically extending bore. The spring 223 acts between the locking pin 221 and an abutment member 225 provided in the diametrically extending bore. An aperture 233 is provided in the outer tappet member 212 to vent the volume between the abutment member 224 and the locking pin 220. The aperture 233 prevents establishment of a hydraulic lock behind the locking pin 220, which could impede the motion of the locking pin 220. In a similar fashion an aperture 234 is provided to vent the volume between the locking pin 221 and the abutment member 225.

A bore will be provided in the inner tappet member 213 to allow supply of hydraulic fluid to act via apertures 227 and 228 in the exterior of the inner tappet member 213 on the radially innermost surfaces of the locking pins 220 and 221. The bore will extend out of the plane of the cross-section shown in FIG. 3 and will align with a bore provided through the outer tappet member 212 which in turn will align with the mouth of a bore provided in the cylinder head of the engine for supply of hydraulic fluid. The pressure of the supply of hydraulic fluid will be switched between a low pressure state and a high pressure state by a control mechanism (not shown).

In use, the valve control mechanism 3 has two operating conditions. In the first operating condition which is shown in FIG. 3 the locking pins 220 and 221 are held out of engagement with the inner tappet member 213 by pressure applied on them by hydraulic fluid supplied to the valve control mechanism 3 to act on the end faces 222A and 221A of the locking pins 222 and 221 respectively. The hydraulic pressure pushes the locking pins 221 and 222 wholly within the diametrically extending bore extending through the outer tappet member 212 so that there is no interaction between the locking pins 220 and 221 and the inner tappet member 213. Consequently, the inner tappet member 213 is free to move with respect to the outer tappet member 212 and the lift of the cam 11 is taken up at least partially by relative movement between the inner tappet member 213 and the outer tappet member 212.

Depending on the dimensions chosen for the valve control mechanism 3 and the lift of the cam 11, the valve 17 can either be fully deactivated in the first operating condition or alternatively the valve 17 can receive a small amount of lift for a short duration. As explained previously, if the lift of the cam 11 is less than the relative motion permitted between the inner and outer tappet members before the inner tappet member abuts the end 236 of the closed bore in the outer tappet member 212, then the valve will be deactivated. However, if the lift of the cam 11 is greater than the maximum permitted relative motion between the inner and outer tappet members, then the top surface 235 of the inner tappet member 213 will come into abutment with the surface 236 forming the closed end of the bore in the outer tappet member 212. When this occurs further increased lift of the cam 11 will be relayed to the controlled valve 17.

In the second operating condition of the tappet assembly 3 the locking pins 222 and 233 are pushed radially inwardly from the outer tappet member 212 to engage the apertures 227 and 228 provided in the outer surface of the inner tappet member 213. The locking pins 222 and 221 are pushed radially inwardly by the biasing force of the springs 222 and 223, when the hydraulic pressure applied on the locking pins 220 and 221 is at a low level, insufficient to counteract the biasing force of the springs 222 and 223. Since the locking pins 220 and 221 engage the apertures 227 and 228 the outer tappet member 212 and the inner tappet member 213 are locked to move together and the full lift of the cam 11 is transmitted by the valve control mechanism from the cam 11 to the controlled valve 17.

The bores in the inner tappet member 213, outer tappet member 212 and cylinder head which relay hydraulic fluid will align with each other when the base circle portion of the cam 11 engages the top surface of the outer tappet member 212. Switching of the valve control mechanism 3 between locked and unlocked conditions will occur only during the base circle portion of the cam and it is not necessary to maintain hydraulic pressure on the locking pins 220 and 221 at other times. When the inner 213 and outer 212 tappet member are not in alignment (i.e. when they are unlocked and the outer tappet member 212 is displaced relative to the inner tappet member 213 by the cam 11) then the locking pins 220 cannot engage the recesses 227 and 228 in the surface of the inner tappet. When the inner 213 and outer 212 tappet member are locked together and both are displaced by the cam 11 then the force transmitted through the locking pins 220 and 221 will be sufficient to retain them in place.

From the above description it will be appreciated that the FIG. 3 embodiment works in a fashion which is the reverse of the FIG. 1 and 2 embodiments. In the FIG. 3 embodiment the inner and outer 212 tappet members are locked to move together when the pressure of the hydraulic fluid supplied to the valve control mechanism 3 is at a low level. The inner 213 and outer 212 tappet members are disconnected so that the controlled valve receives none of or only part of the lift of the cam 11 when the pressure of the hydraulic fluid supplied to the valve control mechanism 3 is at a high level.

The pressure of the hydraulic fluid supply will be controlled by a control system which is not shown in the drawings. The control system will be able to switch the hydraulic pressure from low pressure to high pressure in order that the inner 213 and outer 212 tappet members can be disconnected. Then, when the hydraulic pressure is switched back from high pressure to low pressure the biasing springs 222 and 223 will act to once again connect the inner 213 and outer 212 tappet members.

It is advantageous to have a valve control mechanism in which the tappet members are connected at low oil pressures since when an engine is started oil pressure will be low and it is advantageous at start-up to have all valves activated. The valve control mechanism will be provided with a control system which will monitor one or more of engine speed, load and temperature and will compare measured signals with a mapping table stored in memory, in order to decide whether a particular valve should be activated or deactivated. Thus, for instance, at engine start-up when temperatures are low, the valves may be activated. Then, when the engine temperature is increased, the controller may switch to controlling valve operation in accordance with engine speed, with valves deactivated at low engine speeds and activated at high engine speeds. This aspect of the present invention is not only applicable to valve deactivating tappets as illustrated in the attached drawings, but also the cam profile switching and valve deactivating systems illustrated in the patent specification nos. WO91/12413, EP-A-0265281, EP-A-0343931, EP-A-0364069, EP-A-0293209 as well as in the specifications of unpublished application nos. PCT/GB 94/00619 and GB 9401248.1 and indeed any system having two tappet members (in the form of cylindrical tappets or in the form of rocker arms or finger followers) which can be locked together to move together.

The valve control mechanisms of the invention are simple and compact in nature and do not require substantial modification of the cylinder head of an engine. In fact, it is envisaged that the hydraulic lash adjusters present in conventional engines could simply be replaced by valve control mechanisms according to the present invention, to give existing engines the possibility of valve de-activation. A large number of engines already have hydraulic lash adjusters and oil passages in the cylinder head supplying the hydraulic lash adjusters. It would be a simple matter to replace the hydraulic lash adjusters with tappet assemblies according to the invention and to then provide the engine with means for switching the pressure in the existing oil passages between a high and a low pressure. The valve control mechanism of the invention does not require any machining of the stems of the valves used in the engine and does not require special machining of passages in the cylinder head.

Whilst in the three illustrated embodiments of valve control mechanism are shown in use in an overhead cam engine, the embodiments could be used in push-rod engines. In such a case the inner tappet would engage a push-rod rather than a valve stem.

Whilst in the three illustrated embodiments the outer tappet engages a cam and the inner tappet engages a valve, the mechanism could be used inverted. Also it is not necessary for the tappet members to directly abut a cam and a valve, but instead the tappet members could be part of a larger mechanism for relaying lift from a cam to a valve.

In the three illustrated embodiments the hydraulic supply to the inner tappet member is achieved through aligned bores in the inner and outer tappet members and a bore in the cylinder head which aligns with the bore in the outer tappet member. However, to keep the alignment throughout operation it may be necessary to provide means to prevent the tappet members rotating relative to one another and relative to the cylinder head. The inner and outer tappets can be held in a fixed rotational alignment by insertion of a first pin in matched axially extending grooves on the inner surface of the outer tappet member and the outer surface of the inner tappet member. The outer tappet can be held itself on a fixed rotational position by insertion of a second pin in matched axially extending grooves on the outer surface of the outer tappet member and the inward surface of the cylinder head bore. Alternatively an oil gallery could be provided around the circumference of the outward surface of the outer tappet member or an inward surface of the bore in the cylinder head, to remove the need for fixing the rotational position of the outer tappet member. The gallery would allow hydraulic fluid to be supplied no matter what the relative rotational position of the outer tappet member, as well as having the advantage of providing a lubricating film between abutting surfaces. Whatever configuration is used it must be ensured that the bores and/or galleries are always covered throughout the maximum possible range of relative axial displacements (e.g. the bore in the inner tappet member is always covered by the outer tappet member); otherwise an air lock might develop.

I claim:

1. A valve control mechanism suitable for use in a valve train which transmits lift from a cam located on a camshaft of an internal combustion engine to a cylinder head valve of the internal combustion engine and which has a first abutment member in abutment with the cam and a second abutment member in abutment with the top of the stein of the cylinder head valve, the valve control mechanism comprising:

a first tappet member slidable in a bore in the engine, a second tappet member movable relative to the first tappet member, and locking means capable of locking the first and second tappet members to move together, wherein when the locking mans locks the first and second tappet members to move together the valve control mechanism transmits all of the lift of the cam to the cylinder head valve, and when the locking means allows the first and second tappet members to move relative to each other at least a part ofthe lift of the cam causes relative motion between the first and second tappet members rather than lift of the cylinder head valve, whereby the valve control mechanism reduces the amount of lif that is transmitted from the cam to the cylinder head valve, wherein one of the tappet members is connectable with the camshaft only via the other tappet member, the first tappet member which is an outer tappet member which has a bore therein and the second tappet member is an inner tappet member which is slidable in the bore of the outer tappet member, characterised in that the locking means comprises a locking pin slidable in a bore provided in the outer tappet member and a slot provided in the inner tappet member, the locking pin being slidable between a fist position in which the locking pin extends inwardly from the outer tappet member to engage the slot in the inner tappet member and a second position in which the locking pin is out of engagement with the slot in the inner tappet member, and wherein the locking means comprises spring means for biasing the locking pin into the first position and hydraulic fluid supply means operable to supply hydraulic fluid to apply pressure on the locking pin to slide the locking pin from the first position to the second position against the biasing force of the spring means.

2. A valve control mechanism as claimed in claim 1 wherein a hydraulic lash adjuster is provided in a closed bore in the inner tappet member, the hydraulic lash adjuster in use extending to compensate for wear of components of the engine.

3. A valve control mechanism as claimed in claim 1 wherein biasing means is provided to act between the inner and outer tappets to bias the inner and outer tappets into a position relative to each other in which the locking pin aligns with the slot in the outer tappet member.

4. A valve control mechanism as claimed in claim 3 wherein the biasing means comprises a tapered spring which can be compressed to a substantially flat state and which is located in a closed bore in the outer tappet member.

5. A valve control mechanism as claimed in claim 1 wherein the valve control mechanism transmits none of the lift of the cam to the cylinder head valve when the locking means allows the inner and outer tappet members to move relative to each other.

6. A valve control mechanism as claimed in claim 1 wherein the valve control mechanism transmits a part of the lift of the cam to the cylinder head valve when the locking means allows the inner and outer tappet members to move relative to each other.

7. A valve control mechanism as claimed in claim 6 wherein the bore in the outer tappet member has a closed end.

8. A valve control mechanism as claimed in claim 7 wherein in each rotation of the cam, as the lift of the cam initially increases the inner tappet member slides along the closed bore of the outer tappet member until the inner tappet member abuts the closed end of the bore, whereafter further increasing lift of the cam causes lift of the cylinder head valve.

9. A valve control mechanism as claimed in claim 8 wherein the inner tappet member has a surface which in use faces the closed end of the bore and has oil retaining means provided on the surface, the oil retaining means in use retaining a film of oil on the surface which acts to damp relative motion between the inner and outer tappet members as the surface nears abutment with the closed end of the bore.

10. A valve control mechanism as claimed in claim 5 wherein the bore in the outer tappet member has a closed end.

11. A valve control mechanism suitable for use in a valve train which transmits lift from a cam located on a camshaft of an internal combustion engme to a cylinder head valve of the internal combustion engine and which has a first abutment member in abutment with the cam and a second abutment member in abutment with the top of the stem of the cylinder head valve, the valve control mechanism comprising:

a first tappet member which in use of the valve control mechanism is in engagement with the cam, a second tappet member movable relative to the first tappet member which in use of the valve control mechanism is in engagement with the cylinder head valve, and locking means capable of locking the first and second tappet members to move together, wherein the locking means has a first operating condition in which the locking means locks the first and second tappet members to move together and the valve control mechanism transmits lift from the cam engaged by the first tappet member via the locking means from the first tappet member to the second tappet member and thence to the cylinder head valve, and the locking means has a second operating condition in which the locking means allows the first and second tappet members to move relative to each other and in which no lift is transmitted via the locking means from the first tappet member to the second tappet member, wherein the locking means comprises biasing means which applies a permanent bias on the locking means acting to bias the locking means into the first operating condition, and the locking means comprises a locking pin slidable in a bore in the first tappet member between a first position in which the locking pin interengages the tappet members to link the tappet members to move together and a second position in which the locking pin does not interengage the tappet members and the tappet members are free to move relative to each other, characterised in that the first tappet member is an outer tappet member and the second tappet member is an inner tappet member slidable along the axis of a bore in the outer tappet member, and the locking pin is slidable in a bore in the outer tappet member and the biasing means comprises a spring acting to bias the locking pin inwardly.

12. A valve control mechanism as claimed in claim 11 comprising hydraulic control means which supplies hydraulic fluid via a passage in the inner tappet member to act on the innermost surface of the locking pin.

13. A valve control mechanism as claimed in claim 11 comprising hydraulic control means for controlling the locking means, the hydraulic control means switching the locking means between the first and second operating conditions by controlling the pressure of hydraulic fluid supplied to the locking means, the hydraulic control means supplying a first hydraulic pressure insufficient to overcome the biasing means when controlling the locking means to operate in the first operating condition and a second higher hydraulic pressure sufficient to overcome the biasing means when controlling the locking means to operate in the second operating condition.

* * * * *

UNITED STATES PATENT AND TRADEMARK OFFICE

CERTIFICATE OF CORRECTION

PATENT NO. : 6,076,491
DATED : June 20, 2000
INVENTOR(S) : Jeffrey Allen

It is certified that error appears in the above-identified patent and that said Letters Patent is hereby corrected as shown below:

Title page,
ABSTRACT, change "13", to read -- 10 --.

Columns 13, 14, 15 and 16,
Delete claims 1 through 13 in their entirety and, replace them with claims 15 through 24 which are attached herewith as pages 2 through 6. These 10 replacement claims should then be renumbered to reflect them as claims 1 through 10, respectively.

Claims,
Please cancel Claims 1 and 3-14, without prejudice, and add the following new claims.

1. A valve control mechanism suitable for use in a valve train which transmits lift from a cam located on a camshaft of an internal combustion engine to a cylinder head valve of the internal combustion engine and which has a first abutment member in abutment with the cam and a second abutment member in abutment with the top of the stem of the cylinder head valve, the valve control mechanism comprising:

a first tappet member slidable in a bore in the engine, a second tappet member movable relative to the first tappet member, and locking means capable of locking the first and second tappet members to move together, wherein:

when the locking means locks the first and second tappet members to move together, the valve control mechanism transmits all of the lift of the cam to the cylinder head valve;

when the locking means allows the first and second tappet members to move relative to each other, at least a part of the lift of the cam causes relative motion between the first and second tappet members rather than lift of the cylinder head valve, whereby the valve control mechanism reduces the amount of lift that is transmitted from the cam to the cylinder head valve;

one of the tappet members is connectable with the camshaft only via the other tappet member;

the first tappet member is an outer tappet member which has a bore therein and the second tappet member is an inner tappet member which is slidable in the bore of the outer tappet member;

the locking means comprises a locking pin slidable between a first position in which the locking pin interengages the inner and outer tappet members and a second position in which the locking pin disengages the inner and outer tappet members;

biasing means is provided to act between the inner and outer tappet members to bias the inner and outer tappet members into a position relative to each other in which the locking pin can slide from the second position to the first position to interengage the inner and outer tappet members; and It is certified that error appears in the above-identified patent and that said Letters Patent is hereby corrected as shown below:

means is provided on the outer tappet member to limit motion of the inner tappet member relative to the outer tappet member, the biasing means biasing the inner tappet member into engagement with the means limiting motion of the inner tappet member. --

2. A valve mechanism as claimed in claim 15, wherein the means provided to limit motion of the inner tappet member comprises a snap-ring. --

3. A valve control mechanism as claimed in claim 15 wherein the valve control mechanism transmits none of the lift of the cam to the cylinder head valve when the locking means allows the inner and outer tappet members to move relative to each other. --

4. A valve control mechanism as claimed in claim 15 wherein the valve control mechanism transmits a part of the lift of the cam to the cylinder head valve when the locking means allows the inner and outer tappet members to move relative to each other. --

5. A valve control mechanism as claimed in claim 18 wherein the bore in the outer tappet member has a closed end and, in each rotation of the cam, as the lift of the cam initially increases, the inner tappet member slides along the closed bore of the outer tappet member until the inner tappet member abuts the closed end of the bore, whereafter further increasing lift of the cam causes lift of the cylinder head valve. --

6. A valve control mechanism as claimed in claim 19 wherein the inner tappet member has a surface which in use faces the closed end of the bore and has oil retaining means provided on the surface, the oil retaining means in use retaining a film of oil on the surface which acts to damp relative motion between the inner and outer tappet members as the surface nears abutment with the closed end of the bore. --

7. A vlave control mechanism as claimed in claim 1, wherein the locking pin is slidable in a bore provided in the inner tappet member;

a slot provided in the outer tappet member; and the locking pin in the first position extends outwardly from the inner tappet member to engage the slot in the outer tappet member, the locking pin in the second position is out of engagement with the slot in the outer tappet member. --

8. A valve control mechanism as claimed in claim 1 wherein the locking means comprises spring means for biasing the locking pin into the second position and hydraulic fluid supply means operable to supply hydraulic fluid to apply pressure on the locking pin to slide the locking pin from the second position to the first position against the biasing force of the spring means. --

UNITED STATES PATENT AND TRADEMARK OFFICE

CERTIFICATE OF CORRECTION

PATENT NO. : 6,076,491
DATED : June 20, 2000
INVENTOR(S) : Jeffrey Allen

It is certified that error appears in the above-identified patent and that said Letters Patent is hereby corrected as shown below:

9. A valve control mechanism as claimed in claim 1 wherein a hydraulic lash adjuster is provided in a closed bore in the inner tappet member, the hydraulic lash adjuster in use extending to compensate for wear of components of the engine. --

10. A valve control mechanism as claimed in claim 15 comprising hydraulic control means for controlling the locking means, the hydraulic control means switching the locking means between the first and second operating conditions by controlling the pressure of hydraulic fluid supplied to the locking means. --

Signed and Sealed this

Twelfth Day of February, 2002

*Attest:*

*Attesting Officer*

JAMES E. ROGAN
*Director of the United States Patent and Trademark Office*